US009816346B2

(12) United States Patent
Heggestad

(10) Patent No.: US 9,816,346 B2
(45) Date of Patent: Nov. 14, 2017

(54) EXPANSION CONTROL DEVICE FOR A PACKER BODY AND ALSO A PIPING TOOL, METHOD AND USE FOR CONTROLLING THE EXPANSION OF THE PACKER BODY

(71) Applicant: E HOLSTAD HOLDING AS, Sola (NO)

(72) Inventor: Frode Flugheim Heggestad, Hafslo (NO)

(73) Assignee: E Holstad Holding AS, Sola (NO)

( * ) Notice: Subject to any disclaimer, the term of this patent is extended or adjusted under 35 U.S.C. 154(b) by 409 days.

(21) Appl. No.: 14/396,247

(22) PCT Filed: Apr. 25, 2013

(86) PCT No.: PCT/NO2013/050073
§ 371 (c)(1),
(2) Date: Oct. 22, 2014

(87) PCT Pub. No.: WO2013/165255
PCT Pub. Date: Nov. 7, 2013

(65) Prior Publication Data

US 2015/0107859 A1 Apr. 23, 2015

(30) Foreign Application Priority Data

May 2, 2012 (NO) ..... 20120506

(51) Int. Cl.
*E21B 33/128* (2006.01)
*E21B 33/12* (2006.01)
*E21B 23/06* (2006.01)

(52) U.S. Cl.
CPC ..... *E21B 33/128* (2013.01); *E21B 23/06* (2013.01); *E21B 33/1216* (2013.01)

(58) Field of Classification Search
CPC ..... E21B 33/128; E21B 33/1216; E21B 23/06
See application file for complete search history.

(56) References Cited

U.S. PATENT DOCUMENTS 2,767,794 A 10/1956 Lynes
2,997,107 A * 8/1961 Lynes ..... E21B 33/1216 166/185

(Continued)

FOREIGN PATENT DOCUMENTS

WO 2011/037581 3/2011

*Primary Examiner* — David L Andrews
(74) *Attorney, Agent, or Firm* — Gable Gotwals

(57) ABSTRACT

This invention relates to an expansion-control device (2), a piping tool (46), a method and uses for a packer body (52) on a mandrel (50) with a supporting ring (54; 58) arranged adjacent to an end (56; 60) of the packer body (52). The expansion-control device (2) includes a packer-control element (4; 4*a;* 4*b*) for positioning adjacent to the supporting ring (54; 58) and for radial movement relative to the mandrel (50); and a power-transmission body (6) connected to the packer-control element (4; 4*a;* 4*b*) for the transmission of activating power thereto. What is particular is that the power-transmission body (6) includes a lever body (8) with a fulcrum portion (10), and a lever arm (12) projecting radially from the fulcrum portion (10); the free end of the lever arm (12) being connected to the packer-control element (4; 4*a;* 4*b*); the lever body (8) being rotatable around a rotational axis (22) through said fulcrum portion (10); and the power-transmission body (6) including a torque-supplying device (30) to which the lever body (8) is operatively connected for the supply of torque to the lever body (8), and for the rotation of the lever body (8) around the rotational axis (22).

15 Claims, 11 Drawing Sheets

(56) References Cited

U.S. PATENT DOCUMENTS

| | | | |
|---|---|---|---|
| 3,061,012 | A | 10/1962 | Moosman |
| 6,318,461 | B1 | 11/2001 | Carisella |
| 2004/0194969 | A1 | 10/2004 | Hiorth et al. |

* cited by examiner

EXPANSION CONTROL DEVICE FOR A PACKER BODY AND ALSO A PIPING TOOL, METHOD AND USE FOR CONTROLLING THE EXPANSION OF THE PACKER BODY

CROSS-REFERENCE TO RELATED APPLICATIONS

This is the United States National Phase of PCT Application No. PCT/NO2013/050073 filed 25 Apr. 2013 which claims priority to Norwegian Patent Application No. 20120506 filed 2 May 2012, each of which are incorporated herein by reference.

BACKGROUND OF THE INVENTION

Field of the Invention

The present invention relates to a device for controlling the expansion of a packer body, for example a sleeve-shaped packer body, which is arranged on a pipe stem (a mandrel). Depending on the relevant application, the mandrel may be hollow or solid.

The invention also relates to a piping tool, a method and applications for controlling the expansion of said packer body by means of such an expansion-control device.

A packer body like that must be compressible axially, that is to say in the longitudinal direction of the mandrel, and will typically be formed from an elastic/plastic material of a suitable type, for example from rubber, elastomer material and/or plastics material. As an alternative or addition, even other materials and/or different material qualities may be used if appropriate.

The packer body is generally used in connection with pipe plugs, piping tools and the like, in order to provide a pressure-tight connection against a separate, tubular body, possibly against a surrounding hole wall, as the packer body is being compressed and expanded against the tubular body or against the hole wall. Thus, the tubular body may be constituted by a casing in a well, for example a production tubing, a pipeline on a sea floor or on the surface, a pipe in a processing plant or other plant, or a tubular body in any other connection above or under water. Said hole wall may generally define any hole, for example a borehole in the underground or some other type of hole in any medium.

The packer body may thus be used in connection with, for example, a downhole plug, a well tool, a pressure-testing plug or an anchoring means. Such an anchoring means is often used in combination with such a plug or tool. This anchoring body may be formed as a gripping jaw, a gripping wedge, gripping claw, gripping die or a similar structure provided with hooks, teeth, claws or the like for engagement with said tubular body or hole wall.

Moreover, the packer body may be arranged for expansion radially outwards or radially inwards seen relative to the mandrel on which the packer body is arranged. However, inward radial expansion is conditional on the mandrel being hollow.

BACKGROUND OF THE INVENTION

The invention has its background in problems associated with known structures and methods of expanding, setting, fixing and/or loosening such a packer body relative to an external object, for example a tubular body or a hole wall. It is in particular a question of problems that may arise when the packer body is subjected to great stresses during setting and/or use, for example great axial forces, high pressure, high temperature, erosive particles and/or a chemically aggressive environment. Such conditions may arise, for example, when the packer body is used in connection with an underground well at sea or on shore, for example in a petroleum well.

Under such extreme conditions, the elastic/plastic packer body may, inter alia, extrude or flow into accessible cavities in the proximity of the packer body, for example into cavities in the proximity of the packer body lengthways and/or widthways. Such extrusion is normally the more pronounced the larger the expansion and/or stresses to which the packer body is subjected during setting and/or use. As a rule, this extrusion is undesired and may weaken, possibly completely or partially ruin, the packer body. This may entail, inter alia, poor sealing function during use, possibly the packer body sticking completely to, possibly wedging against, said external object. It may thereby be difficult to loosen the packer body after use, the packer body possibly also getting torn to pieces and becoming ruined by such loosening. In a subterranean well, such a weakened packer body may constitute an incomplete pressure barrier which is possibly associated with pressure/fluid leakage and poor pressure control.

Another property of such an elastic/plastic packer body is that when the packer body is being compressed, expanded and set/used, energy is being stored in it. It is this stored energy that provides for the packer body to be pressed sealingly against said external object. However, the extreme conditions mentioned may result in the packer body disintegrating, eroding or being crushed into pieces, so that the packer body unintentionally loosens.

There is thus a need in the industry for devices that prevent extrusion and/or disintegration of such a packer body during setting and/or use.

THE PRIOR ART AND ITS DRAWBACKS

To remedy the problem of undesired extrusion of said packer body during setting and/or use, the prior art includes several patent publications that disclose various so-called anti-extrusion devices.

As close patent publications, the following publications are mentioned:

- U.S. Pat. No. 3,061,012 A;
- U.S. Pat. No. 6,318,461 B1;
- WO 2011/037581 A;
- U.S. Pat. No. 7,178,602 B2, corresponding to NO 318363 B1; and
- U.S. Pat. No. 7,290,603 B2, corresponding to NO 321083 B3.

All these publications disclose variants of such anti-extrusion devices that in actual fact relate to expansion-control mechanisms for associated packer bodies. Each such expansion-control mechanism provides for controlling the radial expansion of the packer body during its compression and setting against an external object, for example against a pipe. The expansion-control mechanism also provides for the packer body to be held in place within a defined area during use.

Furthermore, each such known expansion-control mechanism includes several individual and overlapping screen elements which can be moved radially outwards, and which together may form an annular and supporting screen against an axially adjacent packer body. In the passive position, the screen elements are retracted, lying more or less parallel to the longitudinal direction of the mechanism. Activation of the screen elements is typically performed by subjecting them to an axial push force from an associated activation device. Such an activation device may be constituted by, for example, an actuator, a driving motor, a hydraulic piston, a separate running tool or a piping tool, for example a pipe plug with anchoring bodies, which is connected to the expansion-control mechanism. During activation, all the screen elements are moved radially outwards into an expanded position, in which, together and in an overlapping configuration, they form said annular and supporting screen against the packer body. The screen is also formed to rest against said external object, for example a pipe.

Said U.S. Pat. No. 3,061,012 A appears to represent the closest prior art. The publication discloses such an annular and supporting screen. Each screen element of the screen is arranged to rotate around an inner element portion and thereby tilt an opposite outer element portion out radially when a push force is supplied to the inner element portion. The outer element portion is formed with a chamfered face, abutting, when in the expanded position, against the packer body and supporting it together with other screen elements of the screen.

U.S. Pat. No. 6,318,461 B1, WO 2011/037581A and U.S. Pat. No. 7,178,602 B2 disclose plug devices, each plug device of which includes such an annular and supporting screen for an adjacent packer body. Each screen element of the screen is connected to an expansion-control mechanism which includes, inter alia, two movable members that are rotatably connected to each other. At its free end, one member is movably connected to, or formed as, a screen element of the screen, whereas the free end of the second member is movably connected to an axially movable activation device. When the activation device supplies an axial push force to the second member, both members are tilted outwards, rotating relative to each other. In this way, all screen elements are activated and may position themselves as a supporting screen against the packer element.

U.S. Pat. No. 7,290,603 B2 also deals with a plug device including such an annular and supporting screen for an adjacent packer body. Each screen element of the screen is connected to an axially movable pressure element. As the pressure element supplies an axial push force to the screen element, the screen element is pushed onto a conical thrust collar which is arranged adjacent to the packer body, and which is sloping towards the screen element. The screen element may thereby be pushed further in the radial direction outwards. In this way, all the screen elements are activated and may position themselves as a supporting screen against the packer body.

The anti-extrusion devices according to the above-mentioned prior art may be encumbered with various drawbacks. Thus, it may be a question of relatively great technical complexity and/or lack of flexibility as far as the structure and/or operation are/is concerned, possibly lack of reliability and/or effectiveness, and/or technical limitations of various components and equipment forming part of the specific device.

As examples of such drawbacks, both U.S. Pat. No. 6,318,461 B1, WO 2011/037581 A and U.S. Pat. No. 7,178,602 B2 describe relatively complex anti-extrusion devices. Besides, U.S. Pat. No. 7,178,602 B2 describes a structure that entails very uneven compression of the packer body during setting, that is to say in which the radially inner portion of the packer body is compressed far more than the radially outer portion thereof. Such uneven compression results in, inter alia, locally high friction in and around the packer body and may weaken, possibly ruin, one or more portions of the packer body.

Further, several such known anti-extrusion devices are encumbered with unduly much friction in connection with the radial expansion and setting of the screen elements of the device against, for example, a surrounding well wall or pipe wall. In this connection, the screen elements may scrape against the well wall/pipe wall and create unduly much friction. This may also lead to insufficient compressive force being supplied to the associated packer body for its adequate expansion and setting. This may further result in incorrect setting of the anti-extrusion device and/or the associated packer body, for example when these have been assembled into a downhole plug. This may also lead to the anti-extrusion device and/or packer body becoming completely or partially ruined, so that the downhole plug will have to be replaced with a new downhole plug.

OBJECT OF THE INVENTION

The supereminent objective of the invention is to remedy or reduce at least one of the drawbacks of the prior art in the relevant field, or at least provide a useful alternative to the prior art in the field.

Further, it is a primary objective of the invention to provide an expansion-control mechanism which effectively prevents the extrusion of a packer body during its expansion (cf. anti-extrusion device).

Further, it is an object to provide an expansion-control mechanism which at least counteracts the environmentally related disintegration of said packer body during use.

It is also an objective to provide an expansion-control mechanism which provides for the least possible friction associated with the radial expansion and setting of said screen elements (hereinafter termed packer-control elements) and the packer body against an external object, for example a well wall or pipe wall.

Another object of the invention is to provide an expansion-control mechanism which has great technical flexibility with regard to its structure and operation.

A further object is to provide an expansion-control mechanism that leads to the most gentle and even compression possible of said packer body.

Yet another object is to provide an expansion-control mechanism which has packer-control elements whose radial travel may be individually matched in order thereby to compensate for any irregularities, for example restrictions, deposits or ovality of the object against which the elements are to be moved, for example against a pipe.

Further, it is an object to provide an expansion-control mechanism that may be used to create a barrier against cross flow in a pipe, for example a casing in a well.

Furthermore, it is an object to provide an expansion-control mechanism that can be used to create a supporting base for a fluid in a well pipe, for example for a highly viscous fluid, cement slurry or the like in a casing in a well.

Additional objects of the invention are to provide a piping tool, a method and also uses based on such an expansion-control mechanism for a packer body, for example a sleeve-shaped packer body.

GENERAL DESCRIPTION OF HOW THE OBJECTS ARE ACHIEVED

The objects are achieved through features as specified in the description below and in the claims that follow.

According to a first aspect of the invention, an expansion-control device is provided for a packer body on a mandrel which is provided with a supporting ring arranged axially adjacent to an end of the packer body, the expansion-control device including:

a packer-control element arranged to be placed axially adjacent to the supporting ring and arranged for radial movement relative to the mandrel; and a power-transmission body operatively connected to the packer-control element for the optional transmission of activating power to the packer-control element.

What is particular about the expansion-control device is that said power-transmission body includes a lever body with (a) a fulcrum portion and (b) a lever arm that projects radially from the fulcrum portion;

that the free end of the lever arm is operatively connected to the packer-control element;

that the lever body is rotatable around an axis of rotation through said fulcrum portion, whereby the lever arm is rotatable around the axis of rotation as well; and that the power-transmission body also includes a torque-supplying device to which the lever body is operatively connected for the optional supply of a torque to the lever body, and for the associated rotation of the lever body around the axis of rotation. The free end of the lever arm and the packer-control element are thereby arranged to be moved radially relative to the mandrel.

As mentioned, the packer body must be axially compressible, that is to say in the longitudinal direction of the mandrel, in order thereby to be expanded radially relative to the mandrel. Such a packer body will typically be sleeve-shaped, but other suitable packer types may be used as well. Further, the packer body may be formed from an elastic/plastic material, for example from rubber, elastomer material, plastics material and/or from other suitable materials if appropriate. The packer body may possibly be constituted by a compound packer body including two or more packer elements that are arranged on said mandrel with possible separating bodies between them. Such packer elements may be arranged axially and/or radially adjacent to each other, that is to say axially following and/or radially onlapping each other. Thus, for example, a compound packer body including three sleeve-shaped and axially successive packer elements with metallic separating rings between them may be used. The two packer elements arranged at the end portions of the packer body are formed from relatively hard rubber or elastomer material, whereas the intermediate packer element is formed from softer rubber or elastomer material. As the packer body is being comic) pressed, the two outer and harder packer elements will provide for a controlled radial expansion of the intermediate and softer packer element against an external object, for example a pipe wall or a hole wall, in order finally to form an effective seal against the external object.

Furthermore, the packer-control element in question may have a configuration as shown in the following exemplary embodiment, but any other appropriate configuration may be used as well. In this connection, the packer-control element is preferably arranged to cooperate with one or more separate and at least partially overlapping packer-control elements to form, all together, in the operative position, a supporting screen against the adjacent supporting ring and the adjacent packer body, as described above in connection with said prior-art screen elements. This screen of packer-control elements is preferably annular and continuous.

Thus, adjacent and overlapping packer-control elements in the screen may have contact areas of complementary designs. Neighbouring packer-control elements preferably have a sufficiently large overlap for the overlap to be maintained all the time when the screen is being activated and expanded in both the radial and the circumferential directions. Examples of such screens with expandable, complementary and overlapping packer-control elements (screen elements) are shown in U.S. Pat. No. 3,061,012 A, in WO 2011/037581 A, in U.S. Pat. No. 7,178,602 B2 and in U.S. Pat. No. 7,290,603 B2, among other documents; cf. the above discussion of the prior art.

Cooperating packer-control elements that are to form such a supporting screen may also be arranged axially adjacent to said supporting ring on a portion of said mandrel, for example on a fixed end portion of the mandrel. As an alternative, such cooperating packer-control elements may be arranged axially adjacent to said supporting ring and be supported and carried on a supporting sleeve extending axially, which is connected to the supporting ring. Such a supporting sleeve is preferably arranged in an axially movable manner on the mandrel.

In addition, said supporting ring and/or supporting sleeve may be provided or formed with suitable guiding elements, for example guiding grooves, guide edges, guide rails, guide rods, recesses or the like, providing for the cooperating packer-control elements to be guided in the radial direction during their activation.

Besides, the lever body of the expansion-control device may have an axis of rotation which is arranged to extend in a circumferential direction relative to the mandrel. Thus, the axis of rotation may be arranged to extend, in the main, perpendicularly to the axial direction of the mandrel.

According to a first embodiment of the expansion-control device, the free end of the lever arm may be movably connected to the packer-control element.

In a first variant of this first embodiment, the free end of the lever arm may include a first pivot head which is rotatably connected to the packer-control element. Thus, the first pivot head may be rotatably arranged in a corresponding recess in the packer-control element.

In a second variant of this first embodiment, the free end of the lever arm may include a toothed cam or arch in movable engagement with a corresponding toothed portion of the packer-control element. Thus, the packer-control element may include a pitch rack which includes said corresponding toothed portion of the packer-control element.

According to a second embodiment of the expansion-control device, said torque-supplying device may include a rotary motor, for example a reversible rotary motor, to which the lever body is rotatably connected, for the optional supply of a torque to the lever body, the rotary motor constituting an activating device for the expansion-control device. If reversible, the rotary motor may be used to activate and push out the associated packer-control element of said screen of such elements, and subsequently to deactivate and retract the packer-control element when, possibly, necessary. Thus, the rotary motor may be constituted by an electromotor, a hydraulic motor or a pneumatic motor.

According to an alternative, third embodiment of the expansion-control device, torque-supplying device may include:

a torque arm projecting radially from the fulcrum portion in a direction not coinciding with the radial direction of the lever arm out from the fulcrum portion; and a driving body which is movably connected to the free end of the lever arm for the optional supply of a torque-generating driving force to the lever body. This driving body is arranged to be connected to an activation device for the expansion-control device.

In a first variant of this third embodiment, the driving body may be arranged in an axially movable manner, wherein the free end of the torque arm includes a second pivot head which is rotatably connected to the axially movable driving body. Thus, the second pivot head may be rotatably arranged in a corresponding recess in the axially movable driving body. As an alternative or addition, the axially movable driving body may include a plunger, a rod, for example a push rod, a piston or the like.

In a second variant of this third embodiment, the driving body may be arranged in an axially movable manner, wherein the free end of the torque arm includes a toothed cam or arch in movable engagement with in a corresponding toothed portion of the axially movable driving body. Thus, the axially movable driving body may include a pitch rack which includes said corresponding toothed portion on the driving body.

According to the first or second variant of the third embodiment, the axially movable driving body may be spring-loaded for matched axial movement of the driving body and thereby for matched radial movement of the packer-control element. The radial travel of the packer-control element may be matched to compensate for any irregularities, for example restrictions, deposits or ovality, of the object against which the element is to be moved.

According to the first or second variant of the third embodiment, and as an alternative or addition, the axially movable driving body may be arranged to be connectable to an axially movable activation device for the expansion-control device. Thus, the axially movable activation device may include one of an actuator and a pusher. Further, the axially movable activation device may be mechanically activated, electrically activated, hydraulically activated and/or pneumatically activate.

In a third variant of this third embodiment, the driving body may include a rotatable worm screw, wherein the free end of the torque arm includes a toothed cam or arch which is rotatably engaged in the worm screw. The rotatable worm screw may thus be connected to a torque limiter for the matched supply of torque to the worm screw, and thereby for the matched radial movement of the packer-control element. The radial travel of the packer-control element may thereby be matched to possibly compensate for any irregularities on the object against which the element is to be moved. The torque limiter may include, for example, a spring-loaded ratchet device of a known type.

As an alternative or addition, the driving body may be arranged to be connectable to a rotatable activation device for the expansion-control device. Thus, the rotatable activation device may include a rotary motor, for example a reversible rotary motor. This rotary motor may be constituted by an electromotor, a hydraulic motor or a pneumatic motor.

According to this third embodiment, seen relative to the position of the mandrel, the free end of the torque arm may be arranged on the inside of the rotational axis of the lever body. An axial push force supplied by the driving body to the free end of the torque arm will thereby supply a torque that lifts the free end of the lever arm away from the mandrel, thus moving the packer-control element radially away from the mandrel.

As an alternative to the latter embodiment variant, the free end of the torque arm, seen relative to the position of the mandrel, may be arranged on the outside of the rotational axis of the lever body. An axial pull force supplied by the driving body to the free end of the torque arm, will thus supply a torque that lifts the free end of the lever arm away from the mandrel, thus moving the packer-control element radially away from the mandrel.

According to a fourth embodiment of the expansion-control device, said lever body may be formed by a toothed wheel which is rotatable around said rotational axis, wherein a first circular sector of the toothed wheel constitutes said lever arm and includes a circumferential first toothed portion which is in movable engagement with a corresponding toothed portion on the packer-control element. Thus, the packer-control element may include a pitch rack which includes said corresponding toothed portion of the packer-control element.

In a first variant of this fourth embodiment, said torque-supplying device may include a rotary motor, for example a reversible rotary motor, to which the toothed wheel is rotatably connected, for the optional supply of torque to the toothed wheel, the rotary motor constituting an activation device for the expansion-control device. The rotary motor may thus be constituted by one of an electromotor, a hydraulic motor and a pneumatic motor.

In a second variant of this fourth embodiment, the torque-supplying device may include:

- a second circular sector of the toothed wheel, which forms a torque arm and includes a circumferential second toothed portion; and
- a driving body with a corresponding toothed portion which is in movable engagement with the circumferential second toothed portion of the toothed wheel. This driving body is arranged to be connectable to an activation device for the expansion-control device.

The driving body may thus be arranged to be axially movable. This axially movable driving body may include a pitch rack which includes the corresponding toothed portion of the driving body. As an alternative or addition, the axially movable driving body may be spring-loaded for matched axial movement of the driving body, and thereby for matched radial movement of the packer-control element. The radial travel of the packer-control element may thereby be matched in order, possibly, to compensate for any irregularities on the object against which the element is to be moved.

As an alternative, the driving body may include a rotatable worm screw which is rotatably engaged in the circumferential second toothed portion of the toothed wheel. This rotatable worm screw may be connected to a torque limiter for a matched supply of torque to the worm screw, and thereby for a matched radial movement of the packer-control element. The radial travel of the packer-control element may thereby be matched to possibly compensate for any irregularities on the object against which the element is to be moved. The torque limiter may include, for example, a spring-loaded ratchet device of a known type.

Further, the driving body may be arranged to be connectable to a rotatable activation device for the expansion-control device. This rotatable activation device may include a rotary motor, for example a reversible rotary motor. Further, the rotary motor may be constituted by an electromotor, a hydraulic motor or a pneumatic motor.

According to a second aspect of the invention, a piping tool with expansion-control function for a packer is provided as well, the tool including:

- a mandrel;
- a packer body arranged on the mandrel;
- a first supporting ring arranged axially adjacent to a first end of the packer body;

a second supporting ring arranged axially adjacent to a second end of the packer body; and an annular assembly of at least two radially movable packer-control elements arranged axially adjacent to at least one of the first supporting ring and the second supporting ring;

at least one of the first supporting ring and the second supporting ring being axially movably arranged on the mandrel; and the at least one axially movable supporting ring being provided with an annular assembly which is also axially movably arranged on the mandrel.

What is particular about the piping tool is that each of said packer-control elements constitutes part of in an expansion-control device according to the first aspect of the invention.

Thus, one or both of the support rings may be axially movably arranged on the mandrel.

As mentioned above, said packer body will typically be sleeve-shaped, but other suitable packer types may be used as well.

Further, in the operative position, said annular assembly of packer-control elements is arranged to form a supporting screen against one of said adjacent supporting rings and the adjacent packer body, as described above. This annular assembly (screen) preferably has overlapping packer-control elements and is thereby continuous.

Furthermore, cooperating packer-control elements that are to form such a supporting screen may be arranged axially adjacent to said supporting ring on a portion of said mandrel, for example on a fixed end portion of the mandrel. As an alternative, such cooperating packer-control elements may be arranged axially adjacent to said supporting ring and be carried on a supporting sleeve extending axially, which is connected to the supporting ring. Preferably, such a supporting sleeve is axially movably arranged on the mandrel.

In addition, said supporting ring and/or supporting sleeve may be provided or formed with suitable guiding elements, for example guiding grooves, guide edges, guide rails, guide rods, guide projections, recesses or the like, which provide for the cooperating packer-control elements to be guided in the radial direction during their activation.

For further details and comments concerning said expansion-control device, reference is made to the preceding discussion of the first aspect of the invention and the description of an exemplary embodiment of the invention below.

Moreover, an annular assembly of at least two radially movable packer-control elements may be arranged axially adjacent to just one of the first supporting ring and the second supporting ring.

As an alternative, an annular assembly of at least two radially movable packer-control elements may be arranged axially adjacent to both the first supporting ring and the second supporting ring.

Further, at least the lever body and the torque-supplying device of the expansion-control device may be arranged in a tubular power-transmission housing which is connected to the mandrel. Thus, the lever body may be provided with a rotary axle which is rotatable around the rotational axis of the lever body, and which is supported in the tubular power-transmission housing.

Furthermore, the lever body may be arranged in an axial recess in the tubular power-transmission housing or, alternatively, in an axial bore in the tubular power-transmission housing. As an alternative or addition, the torque-supplying device may be arranged in an axial recess in the tubular power-transmission housing or, alternatively, in an axial bore in the tubular power-transmission housing.

As an alternative or addition, said at least one axially movable assembly may be connected to at least one activation device for the optional supply of activating power to the power-transmitting bodies of the expansion-control device.

In this connection, said at least one activation device may include at least one of an axially movable activation device and a rotatable activation device. Thus, such an axially movable activation device may include one of an actuator and a pusher, whereas such a rotatable activation device may include a rotary motor. Further, the activation device may be mechanically activated, electrically activated, hydraulically activated and/or pneumatically activated.

Besides, when arranged in a tubular power-transmission housing, the lever body and torque-supplying device of the expansion-control device, possibly said activation device as well, may be protectively arranged under at least one suitable cover, for example a sleeve-shaped cover surrounding the power-transmission housing and its lever body, torque-supplying device and possibly its activation device. During use, this will prevent unwanted particles and dirt from penetrating to said components, possibly hampering the operation thereof.

Moreover, the piping tool and/or said activation device may include at least one locking device or locking mechanism, for example a releasable locking device/locking mechanism which provides for said annular assembly of packer-control elements and the packer body to be kept locked in an expanded position. In this connection, the piping tool and/or activation device may include, for example, suitable latch grooves, locking dogs, retaining rings, detention wedges, detention springs, detention sleeves, self-locking threads or similar locking devices/locking mechanisms.

The mandrel may also be hollow or solid, as mentioned above. However, inward radial expansion of the packer body is conditional on the mandrel being hollow.

According to a third aspect of the invention, a method of controlling the expansion of a packer body on a mandrel is provided as well, the method including the following steps:

arranging a first supporting ring and a second supporting ring axially adjacent to, respectively, a first end and a second end of the packer body;

arranging an annular assembly which includes at least two radially movable packer control elements, axially adjacent to at least one of the first supporting ring and the second supporting ring.

What is particular about the method is that it also includes the following steps:

incorporating each of said packer-control elements in an expansion-control device in accordance with the first aspect of the invention;

activating at least one activation device for the expansion-control device in order thereby to supply a torque to said lever body, rotating the lever body around said rotational axis, whereby the free end of the lever arm and the packer-control element are moved radially away from the mandrel and in the direction of a tubular object, against which the packer body is to be set; and then sliding at least one of the first supporting ring and the second supporting ring against the packer-control element in order thereby to expand the packer-body radially relative to the mandrel. Said supporting rings and said at least one assembly of packer-control elements thereby control the expansion of the packer body.

As mentioned above, said packer body will typically be sleeve-shaped, but other suitable packer types may be used as well.

Further, in the operative position, said annular assembly of packer-control elements is arranged to form a supporting screen against at least one of said adjacent supporting rings and the adjacent packer body, as described above. This annular assembly (screen) preferably has overlapping packer-control elements and is thereby continuous.

For further details and comments concerning said expansion-control device, reference is made here as well to the preceding discussion of the first aspect of the invention and the description of an exemplary embodiment of the invention below.

According to a fourth aspect of the invention, a use of an expansion-control device according to the first aspect of the invention is provided as well, for controlling the expansion of a packer body, for example a sleeve-shaped packer body, on a mandrel.

Finally, according to a fifth aspect of the invention, a use of a piping tool according to the second aspect of the invention is provided, for controlling the expansion of a packer body, for example a sleeve-shaped packer body, on a mandrel in the piping tool.

BRIEF DESCRIPTION OF THE FIGURES OF THE EXEMPLARY EMBODIMENT

In what follows, a non-limiting example of an embodiment of the description is described, wherein.

Figure 1:
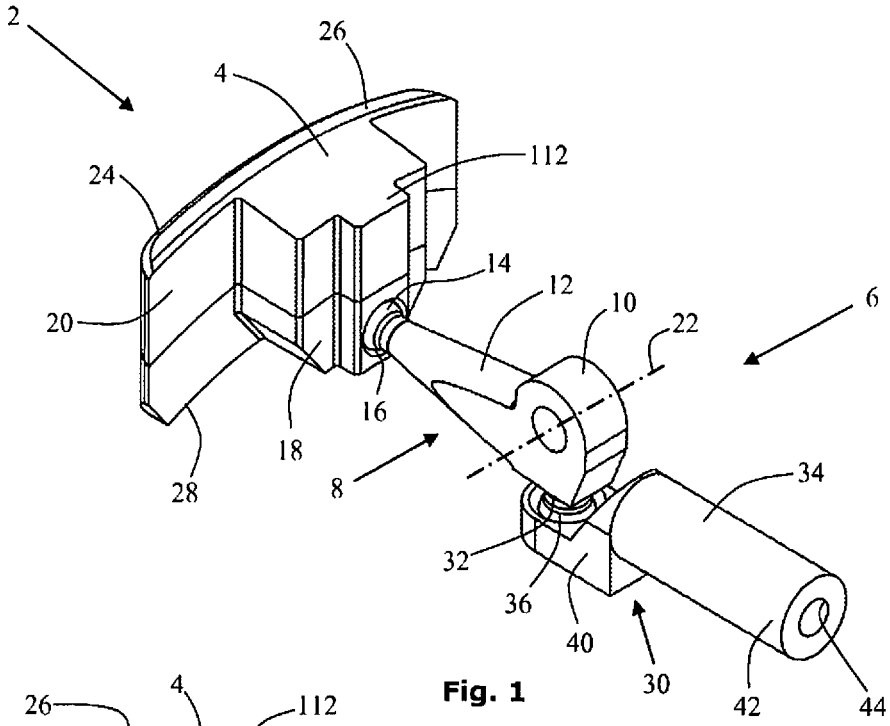
FIGS. 1-5 show, respectively, a perspective drawing, a side view, a plan view, an end view and an opposite end view of an expansion-control device according to the invention.
Figure 2:
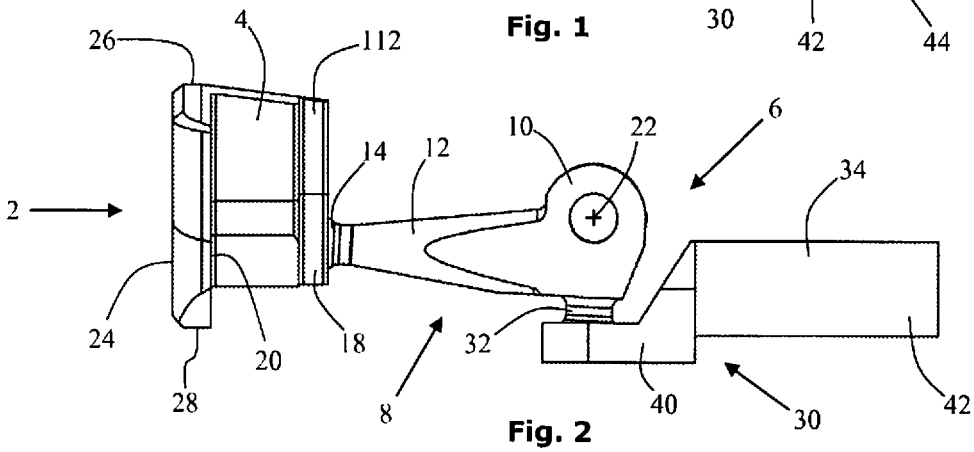
Figure 3:
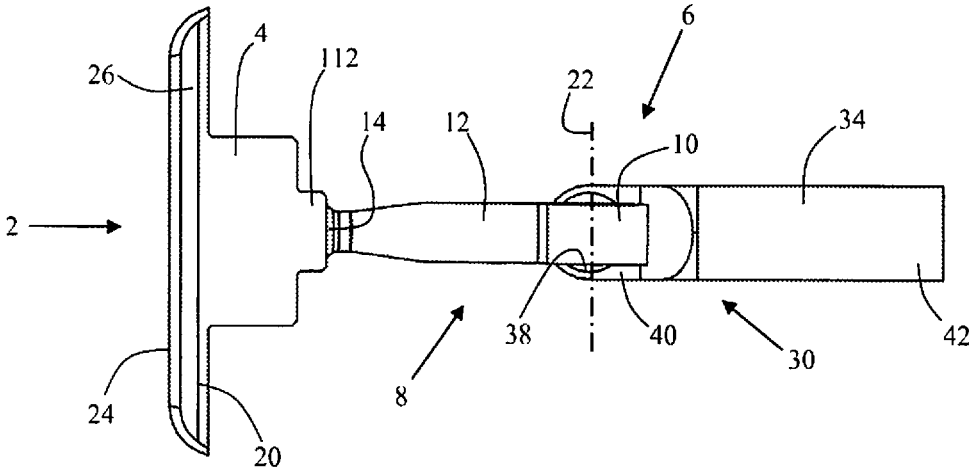
Figure 4:
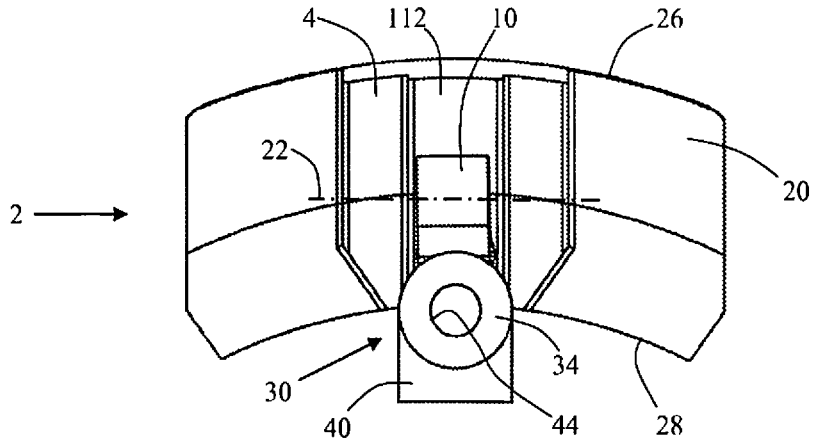
Figure 5:
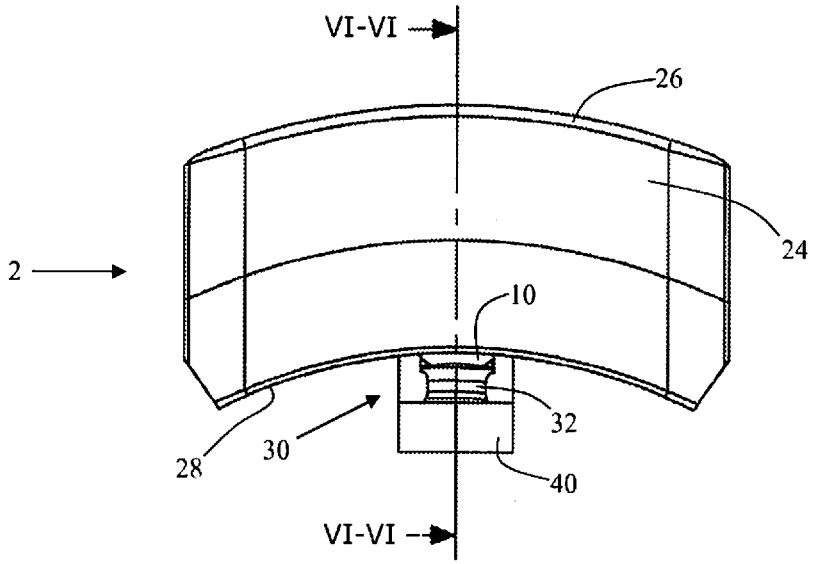
Figure 6:
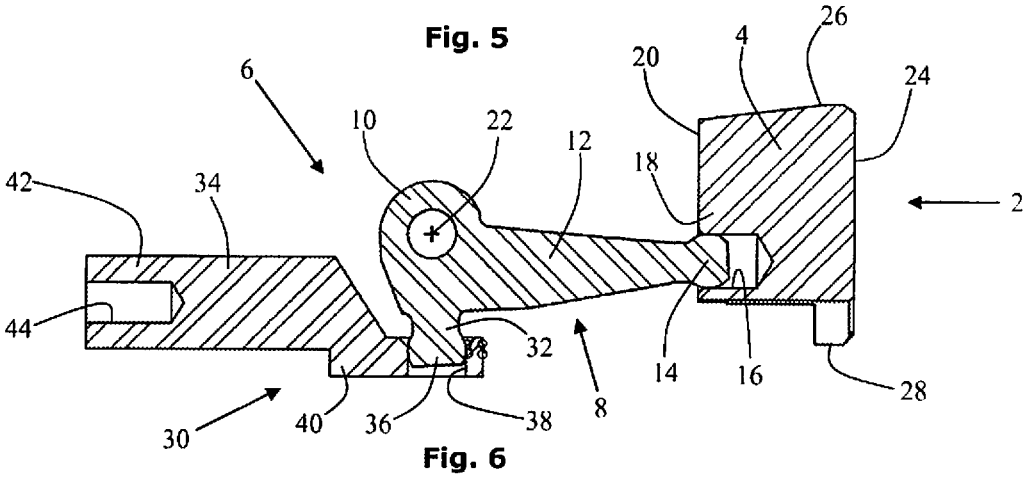
FIG. 6 shows a longitudinal section through the expansion-control device, viewed along the cutting line VI-VI of FIG. 5.
Figure 8:
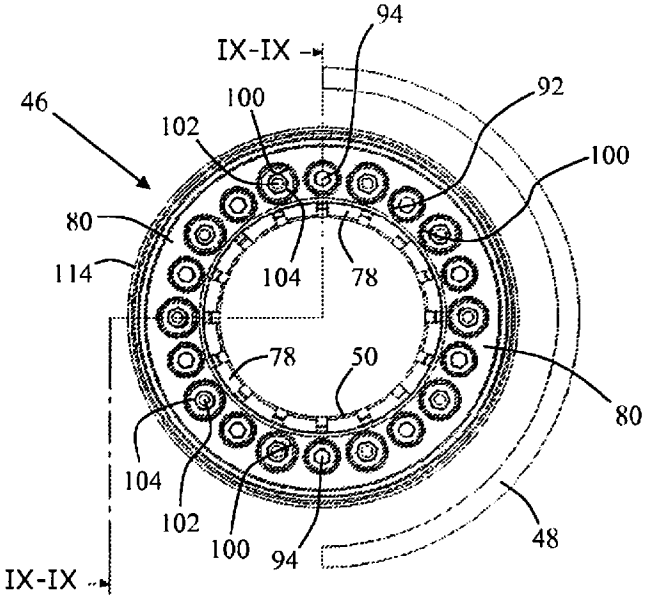
Figure 7:
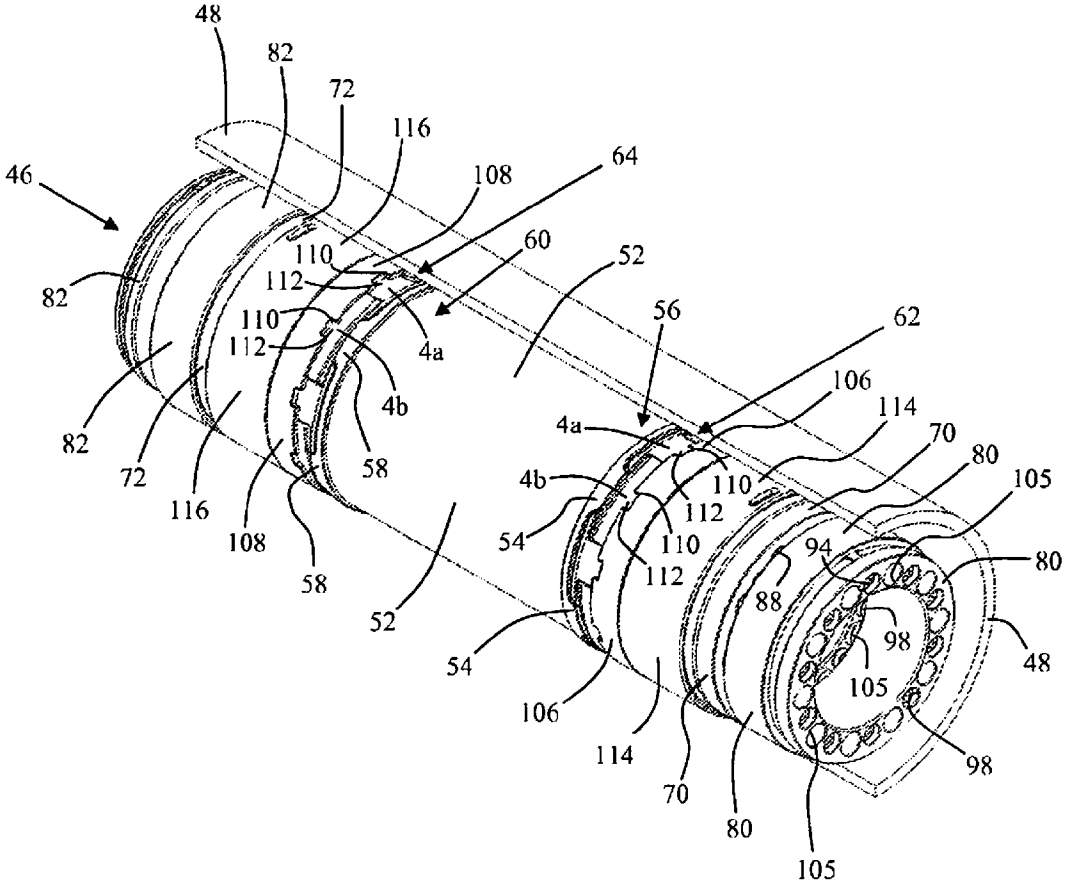
Figure 9:
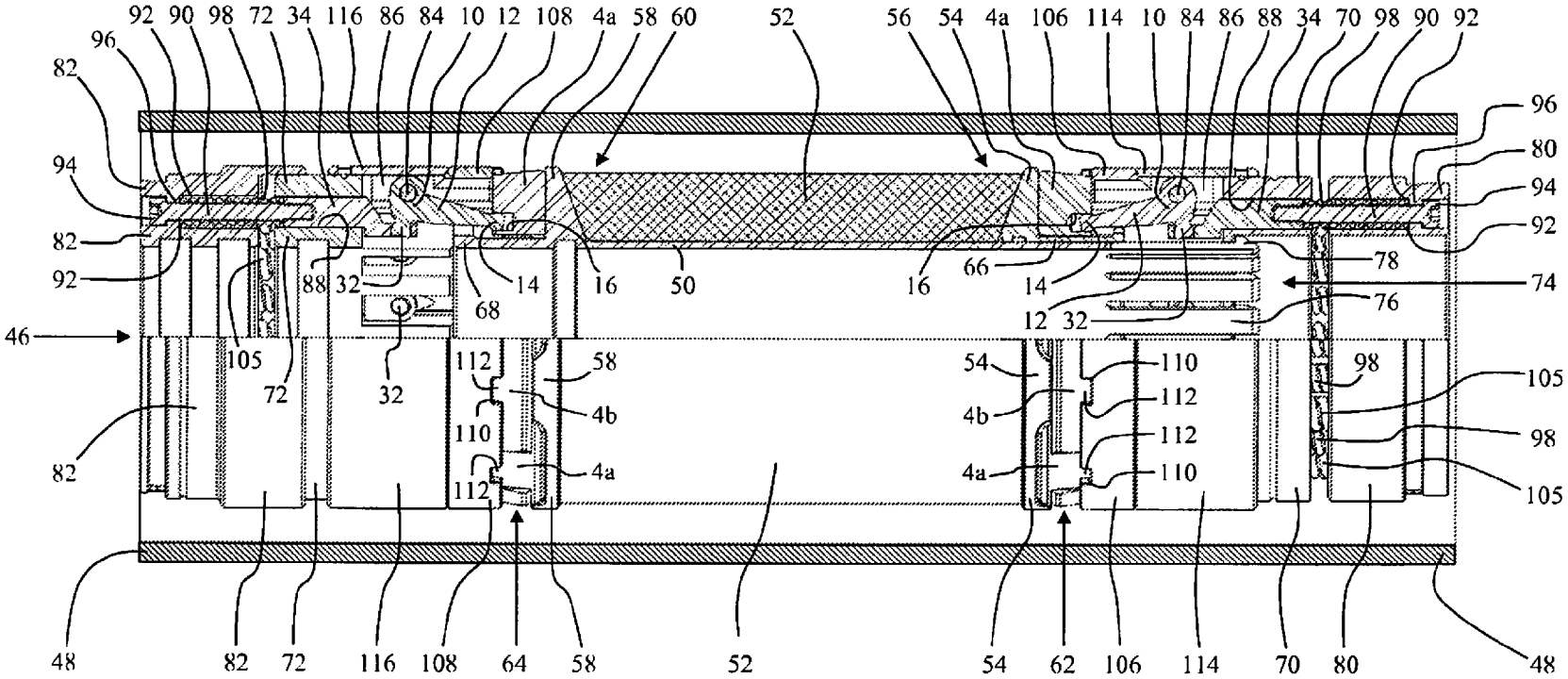
Figure 11:
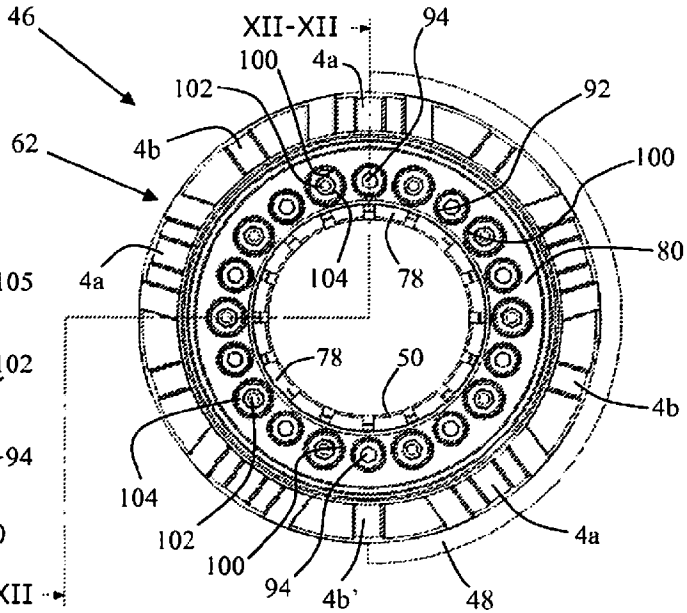
Figure 10:
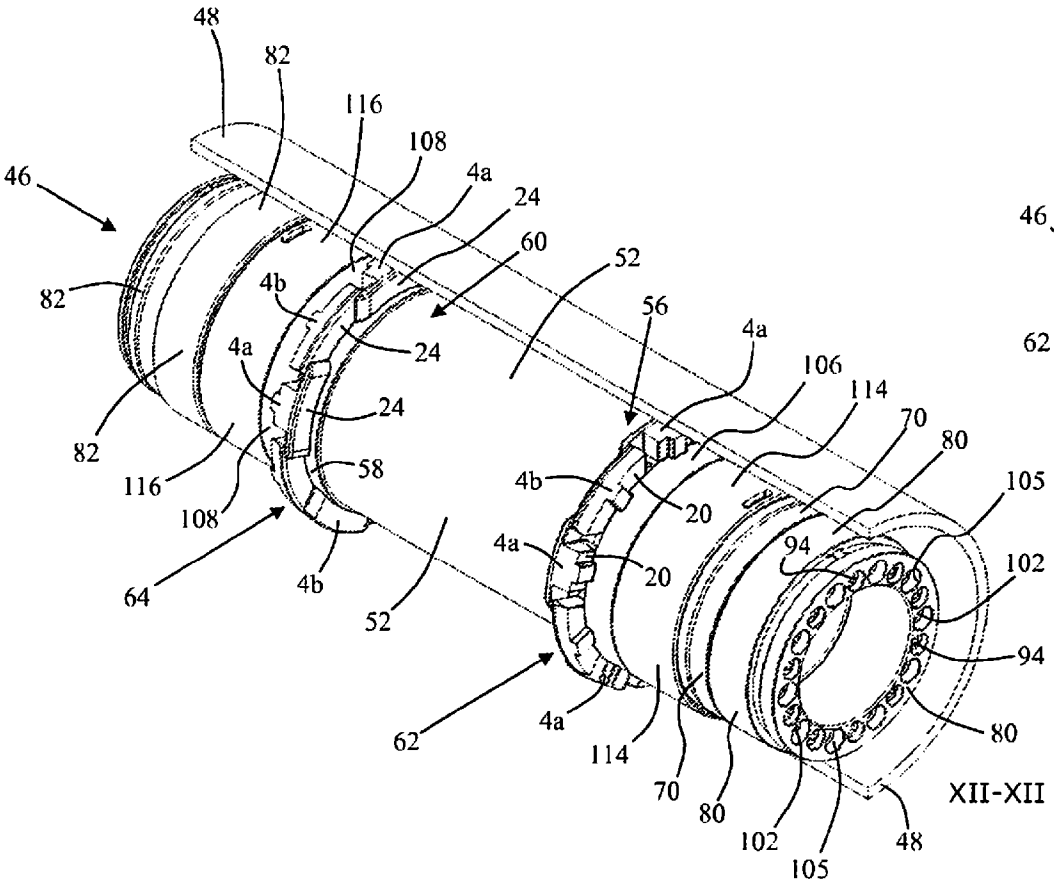
Figure 12:
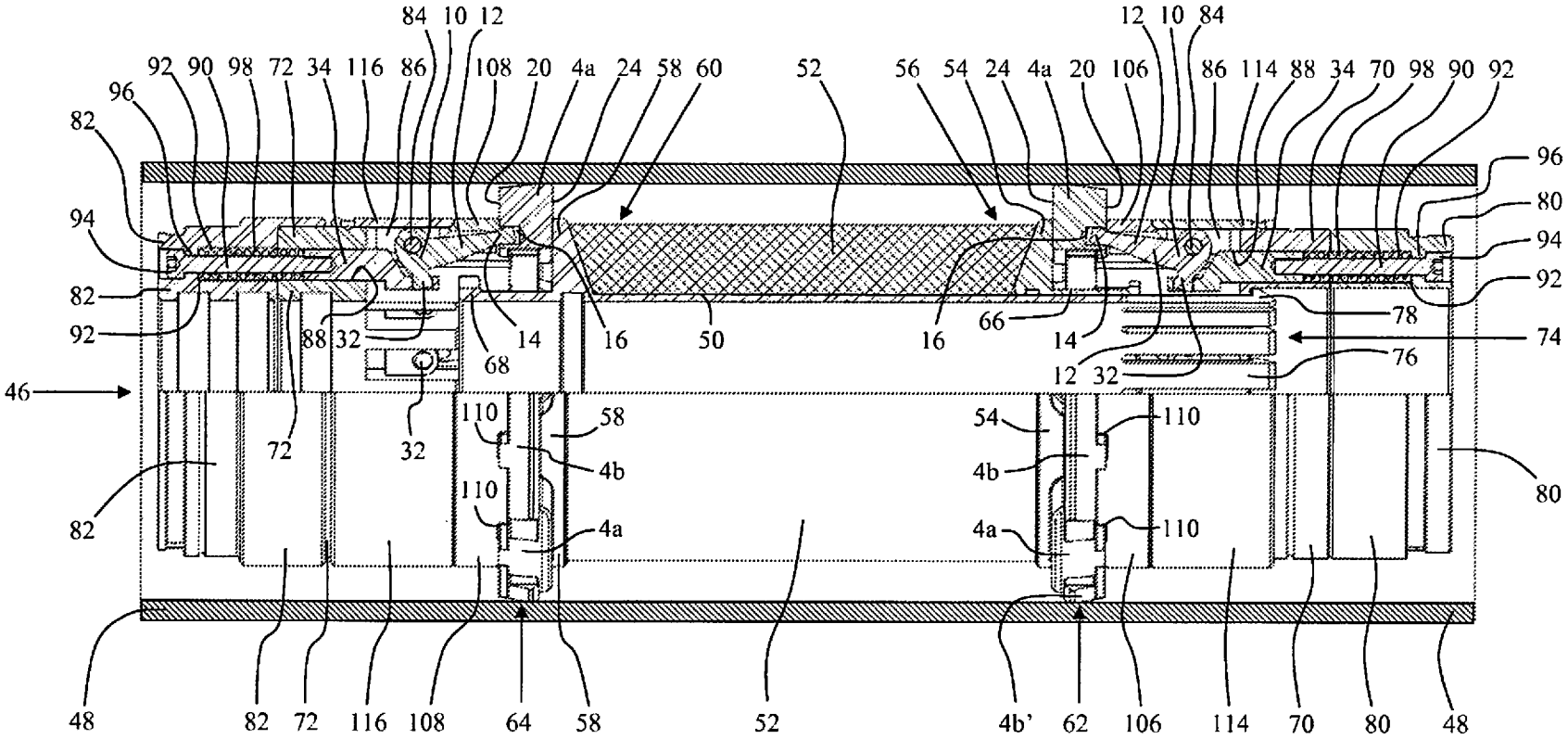
Figure 14:
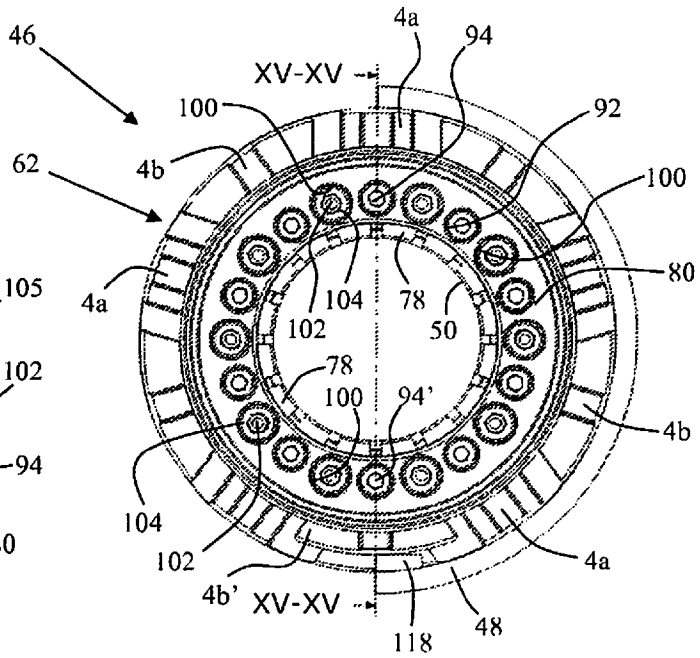
Figure 13:
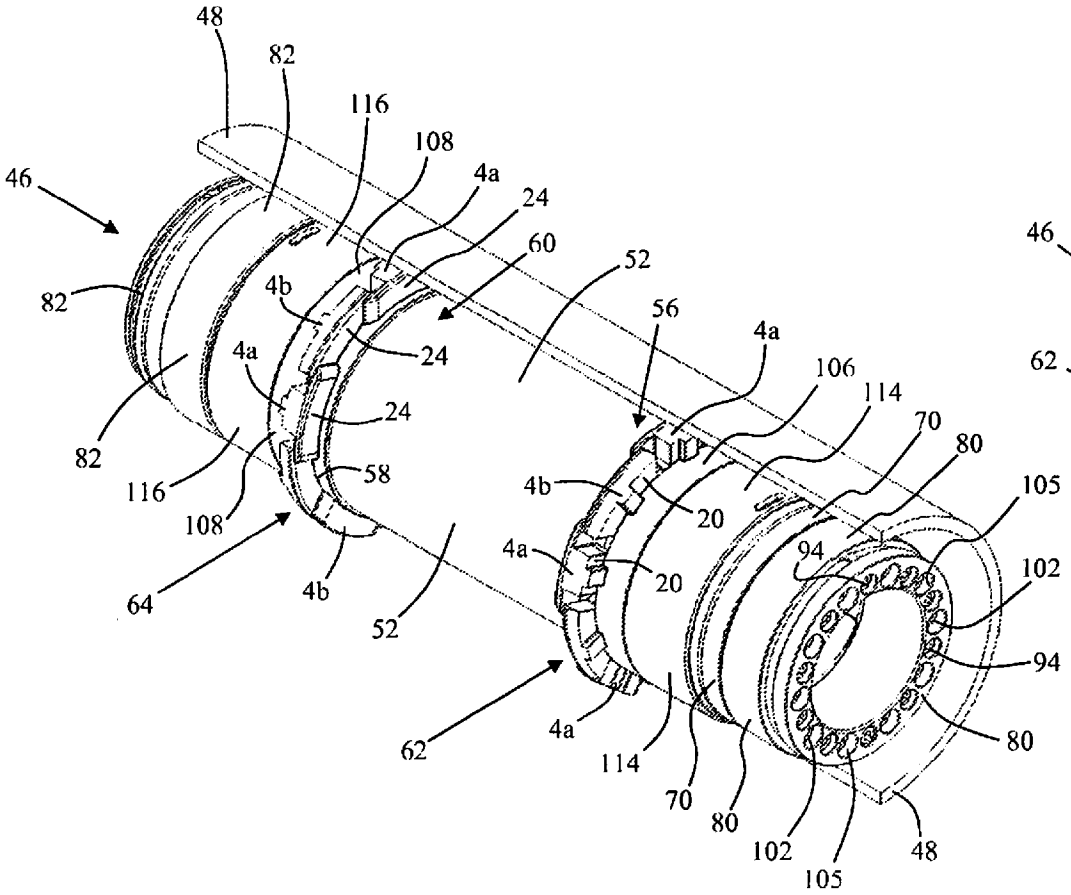
Figure 15:
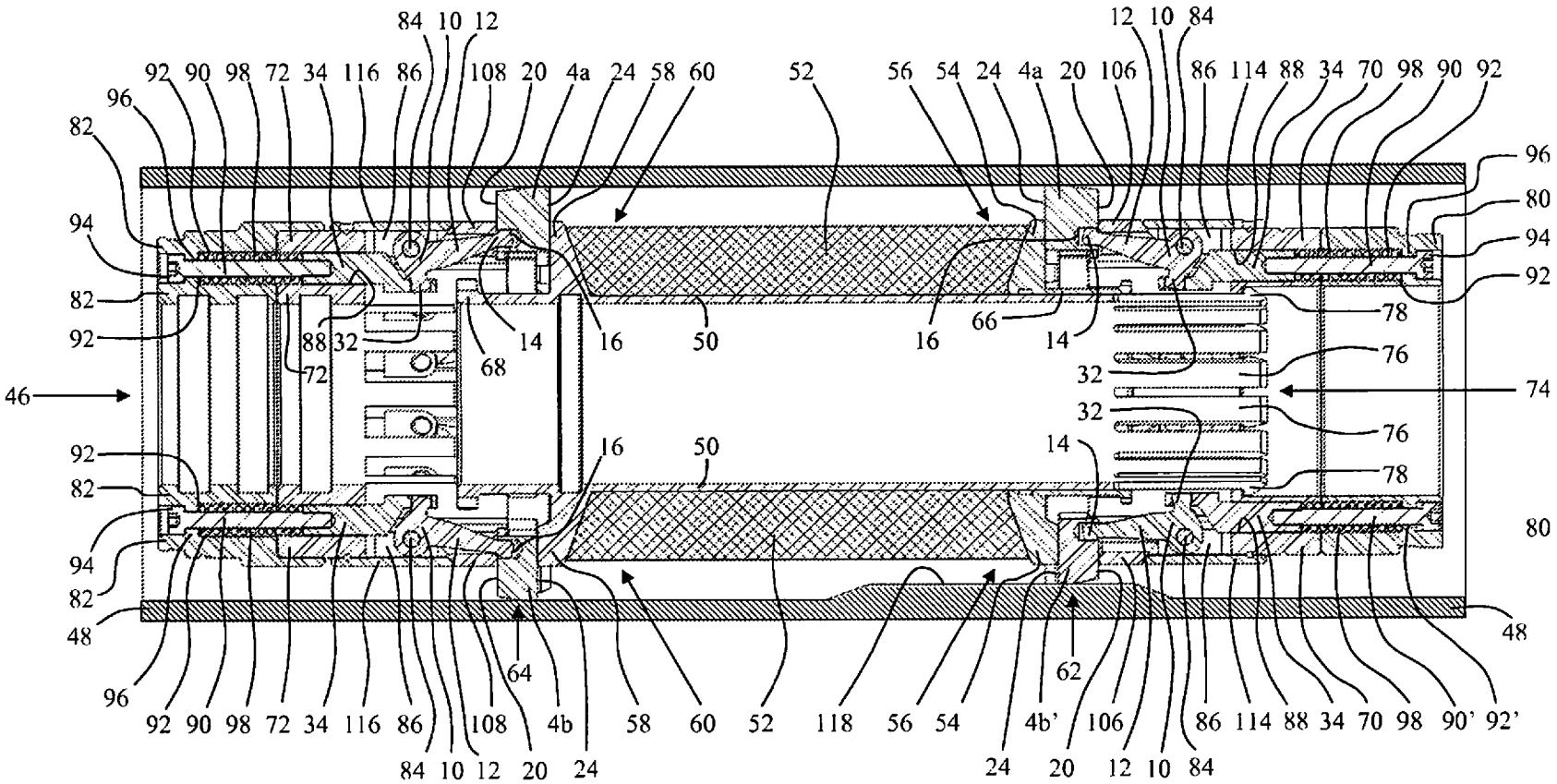
Figure 17:
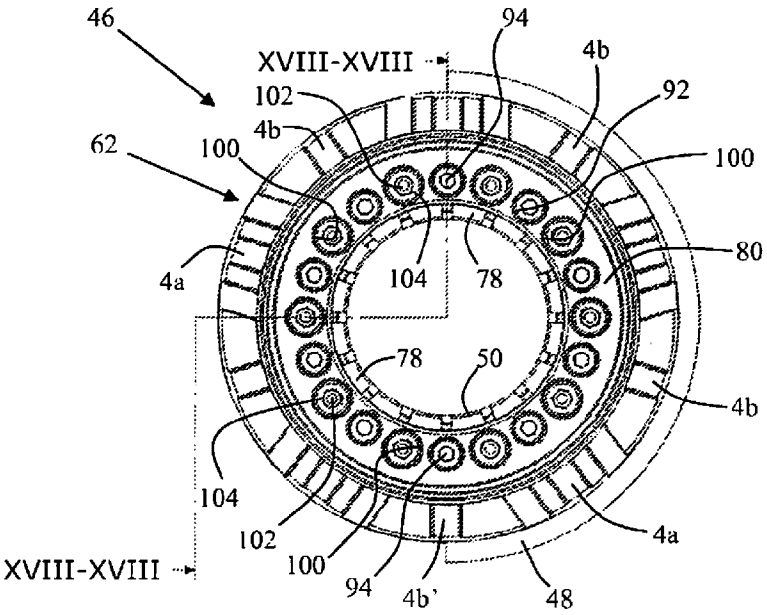
Figure 16:
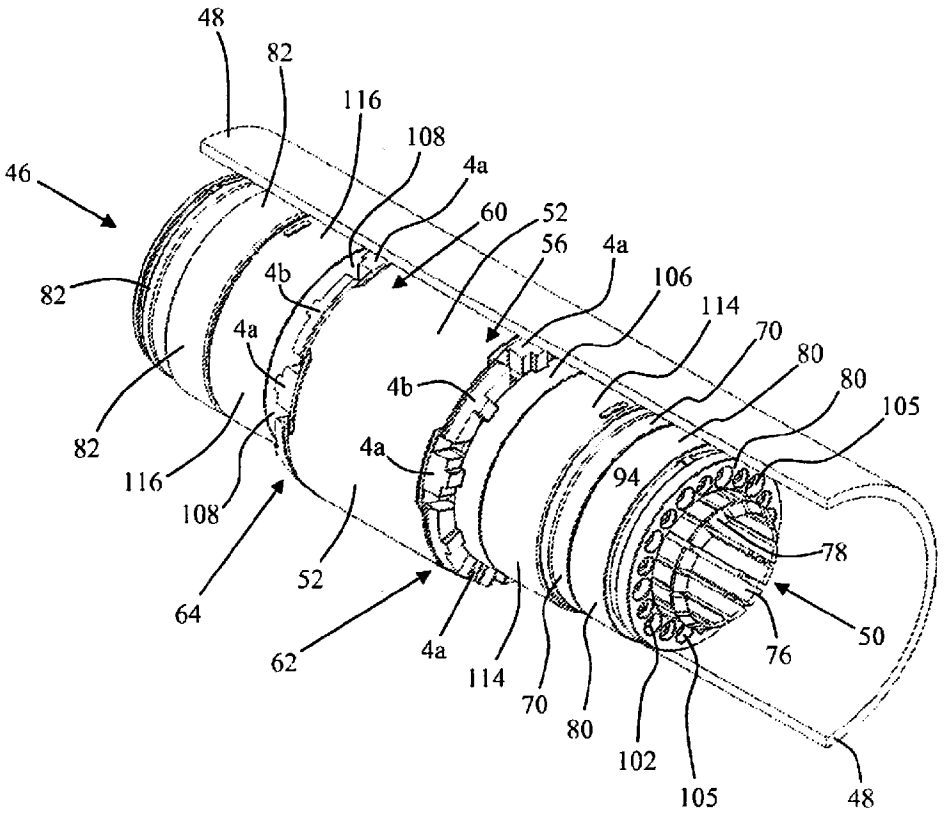
Figure 18:
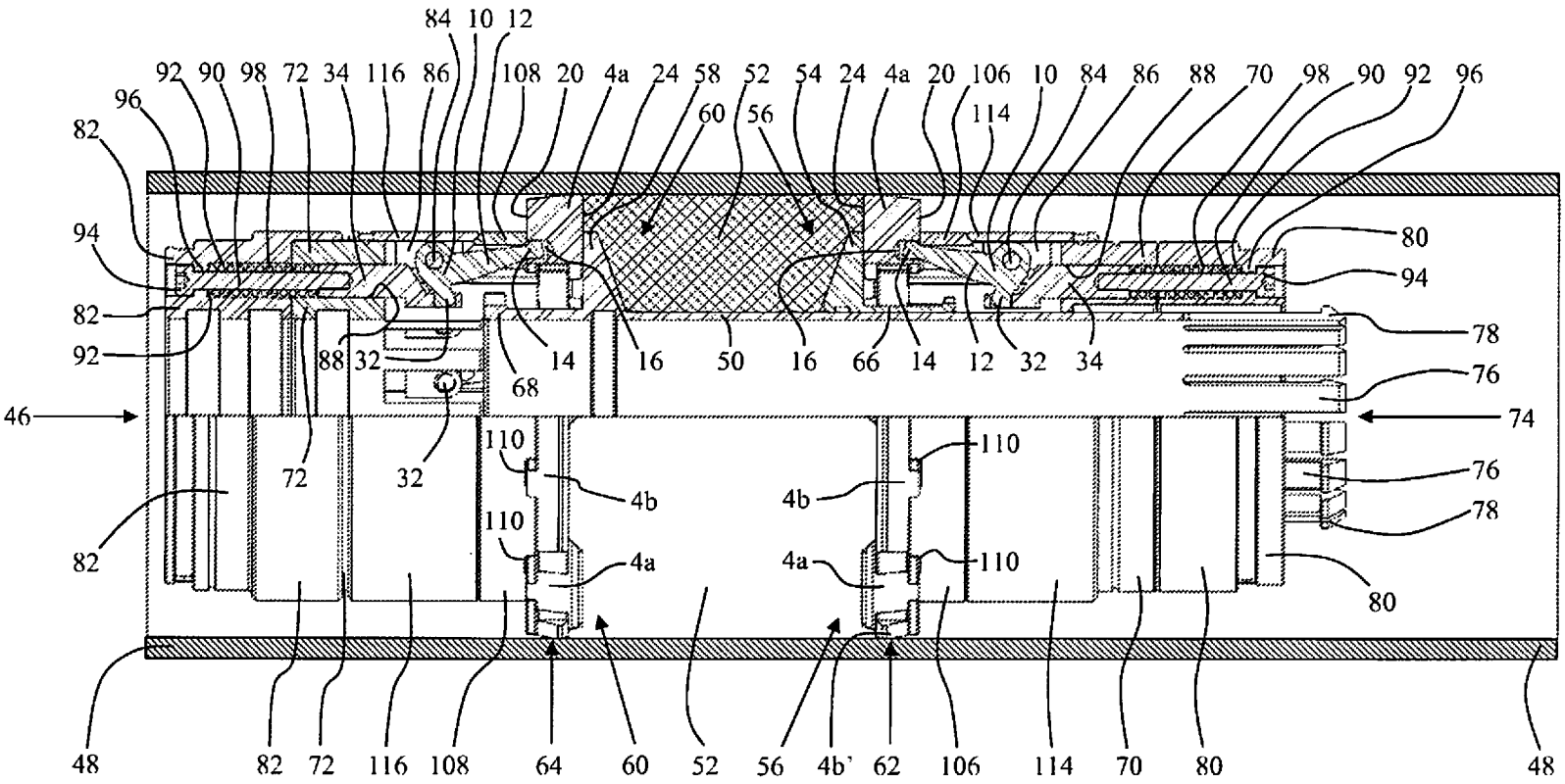

FIGS. 7, 8 and 9 show, respectively, a perspective drawing, a cross section and a longitudinal section of a piping tool according to the invention placed in a casing, FIG. 9 showing a longitudinal section through the piping tool seen along the cutting line IX-IX of FIG. 8, the piping tool being provided with a sleeve-shaped packer body, whose end portions are adjacent to expansion-control devices of the type that is shown in FIGS. 1-6, and FIGS. 7-9 showing the piping tool before the expansion and setting of the packer body against the casing;

FIGS. 10, 11 and 12 show, respectively, a perspective drawing, a cross section and a longitudinal section of said piping tool and casing, FIG. 12 showing a longitudinal section through the piping tool and casing seen along the cutting line XII-XII of FIG. 11, FIGS. 10-12 showing the piping tool after the activation and expansion of said expansion-control devices, but before the expansion and setting of the packer body against the casing;

FIGS. 13, 14 and 15 show, respectively, a perspective drawing, a cross section and a longitudinal section of said piping tool and casing, FIG. 15 showing a longitudinal section through the piping tool and the casing seen along the cutting line XV-XV shown in FIG. 14, FIGS. 13-15 showing the piping tool after the activation and expansion of said expansion-control devices, but before the expansion and setting of the packer body against the casing, and an expansion-control device at one end portion of the packer body having been expanded only partially against the casing because of a local restriction on the inside of the casing; and FIGS. 16, 17 and 18 show, respectively, a perspective drawing, a cross section and a longitudinal section of said piping tool and casing, FIG. 18 showing a longitudinal section through the piping tool and the casing seen along the cutting line XVIII-XVIII shown in FIG. 17, FIGS. 16-18 showing the piping tool after the activation and expansion of said expansion-control devices, and after the expansion and setting of the packer body against the casing.

Figure 20:
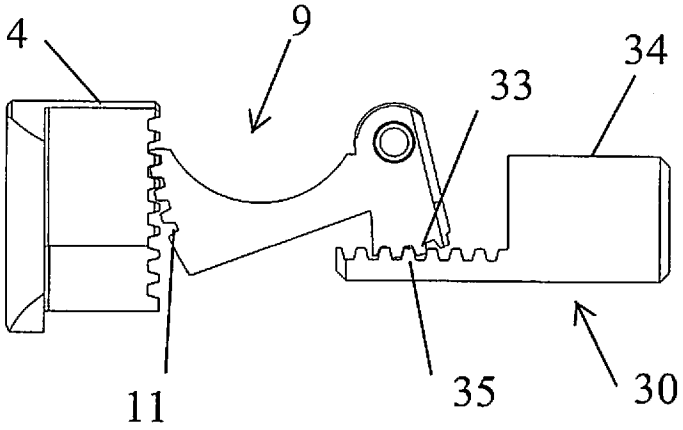
Figure 21:
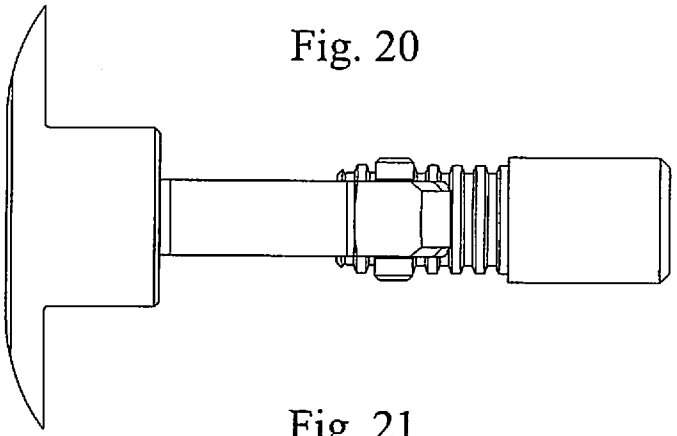
Figure 19:
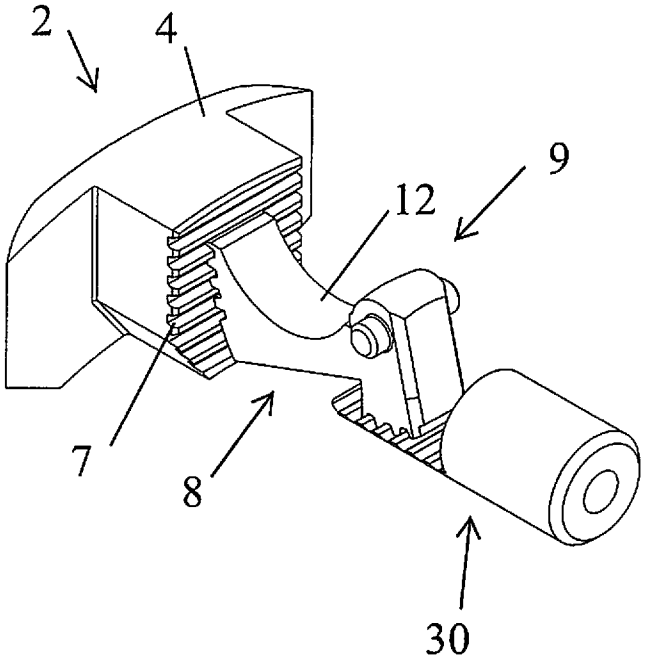

FIGS. 19-21 show, respectively, a perspective drawing, a side drawings and a plan view of an expansion-control device according to the invention.

The figures are somewhat schematic and show elements and details that are essential for the understanding of the invention. Further, the figures may be somewhat distorted with regard to the relative dimensions of the elements and details that are shown in the figures. The figures may also be somewhat simplified drawings with regard to the design and richness in detail of such elements and details. In what follows, some like, equivalent or corresponding elements and details in the figures will be indicated, by and large, by the same reference numerals.

DETAILED DESCRIPTION OF THE EXEMPLARY EMBODIMENT

FIGS. 1-6 show an expansion-control device 2 in accordance with the invention. This expansion-control device 2 includes a packer-control element 4 and a power-transmission body 6 which is movably connected to the packer-control element 4.

Further, the power-transmission body 6 includes, inter alia, a lever body 8 with a fulcrum portion 10, and a lever arm 12 projecting radially from the fulcrum portion 10. In this embodiment, the free end of the lever arm 12 includes a first pivot head 14 which is rotatably arranged in a corresponding bore 16 in a lower portion 18, and at a back 20, of the packer-control element 4. Further, the lever body 8 is rotatable around a rotational axis 22 through said fulcrum portion 10, whereby the lever arm 12 is rotatable around the rotational axis 22 as well.

The packer-control element 4 also includes a front 24 which, in the activated and radially expanded position and together with several cooperating and overlapping packer-control elements, forms an annular and supporting screen against an axially adjacent packer (cf. the above discussion of the prior art). The screen is also arranged to rest against a tubular object, for example against a casing. For this reason, the top side 26 and the bottom side 28 of the packer-control element 4 have the shape of a circular arc which fits complementarily against an associated tubular body, cf. FIGS. 4 and 5.

Furthermore, the power-transmission body 6 also includes a torque-supplying device 30 to which the lever body 8 is operatively connected for the optional supply of torque to the lever body 8, and for the associated rotation of the lever body 8 around the rotational axis 22. In this embodiment, the torque-supplying device 30 includes, inter alia, a torque arm 32 which projects radially from the fulcrum portion 10 at approximately a 90-degree angle relative to the radial direction of the lever arm 12 out from the fulcrum portion 10. The torque-supplying device 30 also includes an axially movable driving body in the form of a push rod 34 (or piston) which is movably connected to the free end of the torque arm 32 for the optional supply of a torque-generating driving force to the lever body 8. In this embodiment, the free end of the torque arm 32 includes a second pivot head 36 which is rotatably arranged in a corresponding hole 38 in a recessed end portion 40 of the axially movable push rod 34. This constitutes said rotary connection between the power-transmission body 6 and the torque-supplying device 30. In addition, an opposite end portion 42 of the push rod 34 is provided with a threaded bore 44 to be connectable to a separate activation device for the expansion-control device 2. The latter will be explained in further detail in connection with FIGS. 7-18.

Reference is now made to FIGS. 7-18, which show a piping tool 46 in accordance with the invention placed in a casing 48. The piping tool 46 in question may be used together with other types of piping tools, for example pipe plugs, pressure-testing plugs, downhole piping tools, anchoring means and the like, as mentioned above.

The piping tool 46 includes a mandrel 50; a sleeve-shaped packer body 52 arranged on the mandrel 50; a first supporting ring 54 which is arranged axially adjacent to a first end 56 of the packer body 52, and which is axially movably arranged on the mandrel 50; a second supporting ring 58 which is arranged axially adjacent to a second end 60 of the packer body 52, and which is stationarily arranged on the mandrel 50; an annular first assembly 62 of several radially movable and overlapping packer-control elements 4 (cf. FIGS. 1-6) arranged axially adjacent to the first supporting ring 54; and an annular second assembly 64 of several radially movable and overlapping packer-control elements 4 arranged axially adjacent to the second supporting ring 58.

Each packer-control element 4 of the assemblies 62, 64 is part of an expansion-control device 2 of the type that is shown in FIGS. 1-6. Each assembly 62, 64 is also arranged to form a continuous, annular and supporting screen against the packer body 52 when each assembly 62, 64 is in the activated and radially expanded position, as described above. In this embodiment, cooperating and overlapping packer-control elements 4 of two slightly different designs are used, packer-control elements 4*a* and packer-control elements 4*b*, respectively. These packer-control elements 4*a* and 4*b* have complementary contact surfaces and lie alternately along the circumference of the assembly; cf. FIGS. 7 and 9. In addition, the packer-control elements 4*a*, 4*b* in question have sufficiently large overlap for the overlap to be maintained all the time when the assemblies 62, 64 (screens) are being activated and expanded in both the radial and the circumferential directions, as shown in FIGS. 10, 11, 13, 14, 16 and 17.

Further, the axially movable first supporting ring 54 is provided with a supporting sleeve 66 extending axially, whereby the supporting sleeve 66 is axially movably arranged on the mandrel 50 as well. The axially movable supporting sleeve 66 supports and carries the packer-control elements 4*a*, 4*b* of the first assembly 62. Thereby, both the first supporting ring 54, the supporting sleeve 66 and the first assembly 62 may be moved axially relative to the mandrel 50 as the packer body 52 is being compressed and expanded, or as the packer body 52 is being relieved.

The second annular assembly 64, on the other hand, which is arranged adjacent to the stationary second supporting ring 58, is arranged directly on a second end portion 68 of the mandrel 50 and will remain stationary relative to the mandrel 50 as the packer body 52 is being expanded or relieved. However, the operation of the second annular assembly 64 is by and large the same as that of the first assembly 62 of packer-control elements 4.

Moreover, the power-transmission body 6 of each packer-control element 4 is arranged in a tubular power-transmission housing placed externally on the mandrel 50, the power-transmission body 6 including said lever body 8 and torque-supplying device 30, including the axially movable push rod 34. For the packer-control elements 4 of the first assembly 62, the respective power-transmission bodies 6 are arranged in a common, tubular first power-transmission housing 70, whereas the respective power-transmission bodies 6 for the packer-control elements 4 of the second assembly 64 are arranged in a common, tubular second power-transmission housing 72 which is at the opposite end of the piping tool 46. Like the associated first supporting ring 54 with the supporting sleeve 66 extending axially, the first power-transmission housing 70 is axially movably arranged on the mandrel 50. To facilitate the fitting of the power-transmission housing 70, the first assembly 62 and the first supporting ring 54 with the supporting sleeve 66 on the mandrel 50, but also to prevent the power-transmission housing 70 from being pushed off the mandrel 50 when the housing 70 is moved axially, a first end portion 74 of the mandrel 50 is provided with radially movable fingers 76 distributed circumferentially, with stop dogs 78 facing outwards at the outer ends of the fingers. The fingers 76 can flex in a radial direction as the power-transmission housing 70 et cetera are being fitted on or dismantled from the mandrel 50, whereas the stop dogs 78 prevent the power-transmission housing 70 et cetera from sliding off the mandrel 50 when being moved axially. The opposite, second power-transmission housing 72, on the other hand, is non-movably attached to said opposite end portion 68 of the mandrel 50.

In addition, each power-transmission housing 70, 72 is connected to a separate, axially movable activation device for joint activation of the power-transmission bodies 6 of each power-transmission housing 70, 72. The associated packer-control elements 4 may thereby be moved radially relative to the mandrel 50. In this embodiment, the respective activation devices are constituted by a tubular first pusher housing 80, connected to the first power-transmission housing 70, and a tubular second pusher housing 82 connected to the second power-transmission housing 72. Depending on the relevant application, each pusher housing 80, 82 may be mechanically activated, electrically activated, hydraulically activated and/or pneumatically activated, for example via a separate running tool (not shown) which is connected to the piping tool 46 whenever necessary, or via another piping tool (not shown), for example a pipe plug with anchoring bodies, which is associated with the pusher housings 80, 82.

In what follows, and owing to the fact that the structures and operations of the power-transmission housings 70, 72 and the pusher housings 80, 82 are by and large similar, components thereof will be designated by the same reference numerals.

Thus, each lever body 8 of the power-transmission body 6 is provided with a rotary axle 84 which is supported in the power-transmission housing 70, 72, and which extends through the fulcrum portion 10 of the lever body 8. The rotary axle 84 defines, and is rotatable around, the rotational axis 22 of the lever body 8, which extends in a circumferential direction relative to the mandrel 50 and, in the main, perpendicularly to the axial direction thereof. In this embodiment, each lever body 8 is arranged in an axial recess 86 in the power-transmission housing 70, 72, whereas each associated and axially movable push rod 34 is arranged in an axial push-rod bore 88 in the power-transmission housing 70, 72.

Furthermore, the threaded bore 44 of each push rod 34 is connected to an associated threaded bolt 90 which is arranged in a corresponding axial spring bore 92 in the pusher housing 80, 82. Each threaded bolt 90 has a bolt head 94 which is supported against an annular shoulder 96 formed in each spring bore 92. A helical spring 98 is also placed around the threaded bolt 90 in each spring bore 92, and between the respective shoulder 96 and end portion 42 of the push rod 34. Each push rod 34 in the power-transmission housing 70, 72 is thereby arranged to be spring-loaded when the pusher housing 80, 82 is moved in the axial direction towards the push rod 34 and packer body 52. The effect of this will be explained in further detail in connection with FIGS. 13-15.

Besides, placed circumferentially between each push-rod bore 88 and corresponding spring bore 92, similar axial spring bores 100 with threaded bolts 102, annular shoulders 104 and helical springs 105 are arranged. These spring bores 100 extend only partially into the power-transmission housing 70, 72 (not shown). The associated helical springs will thereby offer a sprung resistance against the pusher housing 80, 82 when this is activated and moved in the axial direction towards the packer body 52. This prevents unintentional axial movement of the push rods 34 towards the packer body 52, whereby unintentional and potentially destructive radial movement of the packer-control elements 4 out from the mandrel 50 is prevented as well. In a possible subsequent relieving and releasing of the packer-control elements 4 and the packer body 52, said helical springs in the spring bores 100 will also supply a releasing force to the packer-control elements 4, contributing to moving these in towards the mandrel 50.

Moreover, the first and second assemblies 62, 64 (screen) are arranged adjacent to, respectively, a first guide ring 106 and a second guide ring 108, each formed with several circumferential guiding grooves 110 accommodating corresponding guide projections 112 arranged on the back 20 of each packer-control element 4, as shown in FIGS. 7, 10, 13 and 16. In addition, the first and second power-transmission housings 70, 72 are provided with, respectively, a sleeve-shaped first cover 114 and a sleeve-shaped second cover 116 which protectively cover the respective power-transmission bodies 6 in the housings 70, 72, as shown in FIGS. 7, 9, 10, 12, 13, 15, 16 and 18.

The operation of the piping tool 46 will now be explained with reference to FIGS. 7-18.

FIGS. 7-9 show the piping tool 46 placed in the casing 48 before the expansion and setting of the packer body 52 against the casing 48, for example as the piping tool 46 will be configured when being run into the casing 48. In this configuration, the first and second assemblies 62, 64 of packer-control elements 4 have been retracted towards the mandrel 50, whereas the first and second pusher housings 80, 82 are in a passive position with a small axial distance to, respectively, the first and second power-transmission housings 70, 72. At the same time, the first power-transmission housing 70 rests against said stop dogs 78 on the fingers 76 of the mandrel 50.

FIGS. 10-12 show the piping tool 46 after the activation and expansion of the first and second assemblies 62, 64 of packer-control elements 4 against the casing 48, but before the expansion and setting of the packer body 52 against the casing 48. In this configuration, each assembly 62, 64 forms a supporting, mechanical screen against the packer body 52 and against the casing 48. In this connection, the first and second pusher housings 80, 82 have been activated and moved towards, respectively, the first and second power-transmission housings 70, 72, for example by means of a suitable running tool (not shown) or another piping tool (not shown), for example a pipe plug with anchoring bodies, which is moved into the casing 48 simultaneously with the piping tool 46, possibly after the insertion of the piping tool 46. Thereby said axial distance between the pusher housing 80, 82 and the power-transmission housing 70, 72 is closed, but only after the activation force from the power-transmission housing 70, 72 has overcome the sprung resistance from the respective helical springs 105 in said axial spring bores 100. Then the activation force is transmitted to each expansion-control device 2 (that is to say each power-transmission body 6 with the associated packer-control element 4) via a respective push rod 34 in the power-transmission housing 70, 72. As each associated torque arm 32 has a free end located between the fulcrum portion 10 and the mandrel 50, an axial push force from the pusher housing 80, 82, via the respective push rod 34, on the free end of the torque arm 32 will supply a torque to the torque arm 32, lifting the free end of the lever arm 12 out from the mandrel 50 and in a radial direction towards the casing 48.

FIGS. 13-15 show a special variant of the configuration that is shown in FIGS. 10-12. In this special variant, one of the packer-control elements **4*b* of the first assembly 62, that is to say a packer-control element 4*b*', rests against a restriction 118 (or similar obstruction) on the inside of the casing 48, cf. the lower portion of the casing 48 shown in FIGS. 14 and 15. As the restriction 118 projects somewhat into the casing 48 opposite the packer-control element 4*b*', the radial travel of the packer-control element 4*b*' is smaller than the radial travel of the rest of the packer-control elements 4*a*, 4*b* arranged alternately along the circumference of the assembly 62, resting directly against the inside of the casing 48. Thereby the axial movement of a push rod 34' which is associated with the packer-control element 4*b*' is smaller than the axial movement of the rest of the push rods 32 in the power-transmission housing 70 as well, as shown in FIG. 15. This is possible because each push rod 34 is individually spring-loaded via an associated helical spring 98 in a respective spring bore 92 in the first pusher housing 80 (as mentioned above). When the pusher housing 80 is activated and pushed in the axial direction against all the push rods 34 in the first power-transmission housing 70, all the packer-control elements 4*a*, 4*b* (including the packer-control element 4*b*') of the assembly 62 will commence their outward radial travel relative to the mandrel 50. When the packer-control element 4*b*' then hits the restriction 118, thereby stopping its own radial travel and also the axial travel of the push rod 34', the rest of the packer-control elements 4*a*, 4*b* of the assembly 62, and also the associated push rods 34 in the power-transmission housing 70, will still continue their respective radial movements and axial movements, respectively, until the packer-control elements 4*a*, 4*b* hit the inside of the casing 48. During the continued movement of the pusher housing 80 and the rest of the packer-control elements 4*a*, 4*b* with associated push rods 34, a bolt head 94' of a threaded bolt 90' which is connected to the push rod 34' will lift from an annular shoulder 96' formed in an associated spring bore 92' in the pusher housing 80, as shown in FIG. 15**.

In this way, the axial movement of each push rod 34, and also the radial movement of each associated packer-control element 4, will be matched individually in both the first and the second power-transmission housings 70, 72 of the piping tool 46.

Finally, FIGS. 16-18 show the piping tool 46 after the activation and expansion of the first and second assemblies 62, 64 of packer-control elements 4 against the casing 48, and after the expansion and setting of the packer body 52 against the casing 48. In this connection, the first pusher housing 80 has been pushed further towards the axially movable first power-transmission housing 70, for example by means of said running tool (not shown) or said other piping tool (not shown), for example a pipe plug with anchoring bodies. This has then pushed the power-transmission housing 70 and the axially movable first supporting ring 54, including its supporting sleeve 66 extending axially and supporting the packer-control element 4 in the first assembly 62, against the packer body 52 to compress this axially and thereby expand the packer body 52 radially outwards into sealing abutment against the inside of the casing 48. When the setting of the packer body 52 against the casing 48 has been completed, the first power-transmission housing 70, the first pusher housing 80, the first supporting ring 54 and its supporting sleeve 66 extending axially, carrying the first assembly 62, have been pushed inwards along the mandrel 50 and a long way away from the stop dogs 78 at the first end portion 74 of the mandrel 50, as shown in FIGS. 16 and 18.

Moreover, the piping tool 46 and/or its pusher housings 80, 82 may possibly include at least one locking device or locking mechanism, for example a releasable locking device/locking mechanism which provides for the assembly 62, 64 of packer-control elements 4 and the packer body 52 to be locked in an expanded position against the casing 48. In this connection, the piping tool 46 and/or its pusher housings 80, 82, may include, for example, suitable latch grooves, locking dogs, retaining rings, detention wedges, detention springs, detention sleeves, self-locking threads and similar locking devices/locking mechanisms, as mentioned above.

Even though the piping tool 46 according to this embodiment utilizes one type of expansion-control device 2 according to the invention, other piping tools according to the invention may just as well make use of other types of expansion-control devices according to the invention, and possibly a mix of such types of expansion-control devices and/or features from such expansion-control devices. Such other types of expansion-control devices are described in connection with the general part of this description.

FIGS. 19-21 show a free end of the lever arm which includes a toothed cam or arch (9) in moveable engagement with a corresponding toothed portion (11) of the packer-control element (4). Thus, the packer-control element may include a pitch rack which includes the corresponding toothed portion of the packer-control element.

The driving body (34) may be arranged in an axially movable manner, wherein the free end of the torque arm includes a toothed cam or arch in movable engagement with a corresponding toothed portion (35) of the axially movable driving body (34). Thus, the axially movable driving body may include a pitch rack which includes the corresponding toothed portion (35) on the driving body.

The driving body (34) may include a rotatable worm screw, wherein the free end of the torque arm includes a toothed cam or arch which is rotatably engaged in the worm screw. The rotatable worm screw may thus be connected to a torque limiter for the matched supply of torque to the worm screw, and thereby for the matched radial movement of the packer-control element may thereby be matched to possibly compensate for any irregularities on the object against which the element is to be moved. The torque limiter may include, for example, a spring-loaded ratchet device of a known type.

While the invention has been described with a certain degree of particularity, many changes may be made in the details of construction and the arrangement of components without departing from the spirit and scope of this disclosure. It is understood that the invention is not limited to the embodiments set forth herein for purposes of exemplification, but is limited only by the scope of the attached claims, including the full range of equivalency to which each element thereof is entitled.

The invention claimed is:

1. An expansion-control device (2) for a packer body (52) on a mandrel (50) which is provided with a supporting ring (54; 58) arranged axially adjacent to an end (56; 60) of the packer body (52), the expansion-control device (2) comprising:

a packer-control element (4; 4*a*; 4*b*) arranged to be placed axially adjacent to the supporting ring (54; 58) and also arranged for radial movement relative to the mandrel (50);

a power-transmission body (6) operatively connected to the packer-control element (4; 4*a*; 4*b*) for the optional transmission of activating power to the packer-control element (4; 4*a*; 4*b*), wherein said power-transmission body (6) includes a lever body (8) with a fulcrum portion (10), and a lever arm (12) projecting radially from the fulcrum portion (10);

a free end of the lever arm (12) is operatively connected to the packer-control element (4; 4*a*; 4*b*);

the lever body (8) is rotatable around a rotational axis (22) through said fulcrum portion (10), whereby the lever arm (12) is rotatable around the rotational axis (22) as well; and the power-transmission body (6) also includes a torque-supplying device (30) to which the lever body (8) is operatively connected for the optional supply of torque to the lever body (8), and for the associated rotation of the lever body (8) around the rotational axis (22), whereby the free end of the lever arm (12) and the packer-control element (4; 4*a*; 4*b*) are arranged to be moved radially relative to the mandrel (50);

the torque-supplying device (30) comprising a torque arm (32) projecting radially from the fulcrum portion (10) in a direction not coinciding with the radial direction of the lever arm (12) out from the fulcrum portion (10) and a driving body (34; 34') movably connected to a free end of the torque arm (32) for optional supply of a torque-generating driving force to the lever body (8), the driving body (34; 34') being connected to an activation device for the expansion-control device (2).

2. The expansion-control device (2) according to claim 1, wherein the free end of the lever arm (12) is movably connected to the packer-control element (4; 4*a*; 4*b*).

3. The expansion-control device (2) according to claim 2, wherein the free end of the lever arm (12) includes a first pivot head (14) which is rotatably connected to the packer-control element (4; 4*a*; 4*b*).

4. The expansion-control device (2) according to claim 1, wherein the driving body (34; 34') is arranged to be axially movable; and the free end of the torque arm (32) includes a second pivot head (36) which is rotatably connected to the axially movable driving body (34; 34').

5. The expansion-control device (2) according to claim 4, wherein the axially movable driving body includes a push rod (34; 34').

6. The expansion-control device (2) according to claim 4 wherein the axially movable driving body (34, 34') is spring-loaded for matched axial movement of the driving body (34; 34'), and thereby for matched radial movement of the packer-control element (4; 4*a*; 4*b*).

7. The expansion-control device (2) according to, claim 1 wherein seen relative to the position of the mandrel (50), the free end the torque arm (32) is arranged on the inside of the rotational axis (22) of the lever body (8), whereby an axial push force supplied by the driving body (34; 34') to the free end of the torque arm (32) will supply a torque that lifts the free end of the lever arm (12) away from the mandrel (50) and, thus, moves the packer-control element (4; 4*a*; 4*b*) radially away from the mandrel (50).

8. The expansion control device (2) according to claim 1, wherein said lever body (8) is constituted by a toothed cam (9) which is rotatable around said rotational axis (22); and a first circular sector of the toothed cam (9) constitutes said lever arm (12) and includes a circumferential first toothed portion (11) which is in movable engagement with a corresponding toothed portion (7) on the packer-control element (4; 4*a*, 4*b*).

9. The expansion-control device (2) according to claim 8, wherein the torque-supplying device (30) includes:

a second circular sector of the toothed cam (9) which forms the torque arm (32), and which includes a circumferential second toothed portion (33); and a corresponding toothed portion (35) on the driving body (34; 34') which is in movable engagement with the circumferential second toothed portion (33) of the toothed cam (9), the driving body (34; 34') being arranged to be connectable to an activation device for the expansion-control device (2).

10. The expansion-control device (2) according to claim 9, wherein the driving body (34; 34') is axially movably arranged.

11. The expansion-control device (2) according to claim 10, wherein the axially movable driving body (34; 34') is spring-loaded for matched axial movement of the driving body (34; 34'), and thereby for matched radial movement of the packer-control element (4; 4*a*; 4*b*).

12. A piping tool (46) with expansion-control function for a packer, the tool (46) including:

a mandrel (50);

a packer body (52) arranged on the mandrel (50);

a first supporting ring (54) arranged axially adjacent to a first end (56) of the packer body (52);

a second supporting ring (58) arranged axially adjacent to a second end (60) of the packer body (52); and an annular assembly (62; 64) of at least two radially movable packer-control elements (4; 4*a*; 4*b*) arranged axially adjacent to at least one of the first supporting ring (54) and the second supporting ring (58);

at least one of the first supporting ring (54) and the second supporting ring (58) being axially movably arranged on the mandrel (50);

the at least one axially movable supporting ring (54; 58) being provided with the annular assembly (62; 64) which is also axially movably arranged on the mandrel (50), wherein each of said packer-control elements (4; 4*a*; 4*b*) forms part of an expansion-control device (2); and at least a lever body (8) and a torque-supplying device (30) of the expansion-control device (2) arranged in a tubular power-transmission housing (70; 72) which is connected to the mandrel (50), the torque-supplying device (30) comprising a torque arm (32) projecting radially from a fulcrum portion (10) of the lever body (8) in a direction not coinciding with a radial direction of a lever arm (12) projecting radially from the fulcrum portion (10) and a driving body (34; 34') movably connected to a free end of the torque arm (32), the driving body (34; 34') being connected to an activation device for the expansion-control device (2).

13. The piping tool according to claim 12, wherein the annular assembly (62; 64) of at least two radially movable packer-control elements (4; 4*a*; 4*b*) is arranged axially adjacent to both the first supporting ring (54) and the second supporting ring (58).

14. The piping tool (46) according to claim 12, wherein the at least one axially movable assembly (62; 64) is connected to at least one activation device for optional supply of activating power to power-transmission bodies (6) of the expansion-control device (2).

15. A method of controlling the expansion of a packer body (52) on a mandrel (50), the method including comprising the following steps:

arranging a first supporting ring (54) and a second supporting ring (58) axially adjacent to, respectively, a first end (56) and a second end (60) of the packer body (52);

arranging an annular assembly (62; 64) which includes at least two radially movable packer-control elements (4; 4*a*, 4*b*), axially adjacent to at least one of the first supporting ring (54) and the second supporting ring (58), incorporating each of said packer-control elements (4; 4*a*; 4*b*) in an expansion-control device (2);

activating at least one activation device for the expansion-control device (2) connected to a driving body (34; 34') movably connected to a free end of a torque arm (32), the torque arm (32) projecting radially from a fulcrum portion (10) of a lever body (8) in order thereby to supply a torque to said lever body (8), rotating the lever body (8) around a rotational axis (22), whereby a free end of a lever arm (12) and the packer-control element (4; 4*a*; 4*b*) are moved radially away from the mandrel (50) and in the direction of a tubular object (48) against which the packer body (52) is to be set; and moving at least one of the first supporting ring (54) and the second supporting ring (58) against the packer-control element (4; 4*a*; 4*b*) in order thereby to expand the packer body (52) radially relative to the mandrel (50), whereby said supporting rings (54, 58) and said at least one assembly (62; 64) of packer-control elements (4; 4*a*; 4*b*) control the expansion of the packer body (52).

* * * * *